US009169692B2

(12) United States Patent
Loper

(10) Patent No.: US 9,169,692 B2
(45) Date of Patent: Oct. 27, 2015

(54) DEPLOYABLE VISION OBSTRUCTER

(71) Applicant: Deborah Marie Loper, Old Lyme, CT (US)

(72) Inventor: Deborah Marie Loper, Old Lyme, CT (US)

( * ) Notice: Subject to any disclaimer, the term of this patent is extended or adjusted under 35 U.S.C. 154(b) by 0 days.

(21) Appl. No.: 14/197,982

(22) Filed: Mar. 5, 2014

(65) Prior Publication Data

US 2014/0251559 A1 Sep. 11, 2014

Related U.S. Application Data

(60) Provisional application No. 61/773,456, filed on Mar. 6, 2013.

(51) Int. Cl.

| | |
|---|---|
| ***A47G 5/02*** | (2006.01) |
| ***E06B 9/42*** | (2006.01) |
| ***E06B 7/30*** | (2006.01) |

(52) U.S. Cl.
CPC .... *E06B 9/42* (2013.01); *E06B 7/30* (2013.01)

(58) Field of Classification Search
CPC ..... E06B 9/66; E06B 9/64; A47G 5/02
USPC ..... 160/243, 242, 246, 251; 135/117
See application file for complete search history.

(56) References Cited

U.S. PATENT DOCUMENTS

| | | | | | |
|---|---|---|---|---|---|
| 227,262 | A * | 5/1880 | Kendall | 296/138 |
| 262,609 | A * | 8/1882 | Myrick | 296/143 |
| 1,615,931 | A * | 2/1927 | Cann | 160/239 |
| 2,336,899 | A * | 12/1943 | Stern | 160/243 |
| 2,580,555 | A * | 1/1952 | Kroeger | 4/502 |
| 5,427,169 | A * | 6/1995 | Saulters | 160/368.1 |
| 5,996,674 | A * | 12/1999 | Gatewood | 160/348 |
| 6,209,614 | B1 * | 4/2001 | Smoot | 160/237 |
| 7,320,353 | B1 * | 1/2008 | Miller et al. | 160/89 |
| 2014/0251559 | A1 * | 9/2014 | Loper | 160/323.1 |

* cited by examiner

*Primary Examiner* — Blair M Johnson

(57) ABSTRACT

A deployable vision obstructer for use in lockdown drills and procedures. A flexible shade is attached to a door surface above a window by means of a mounting assembly connected to a proximal end of the flexible shade. The flexible shade is configurable between a retracted position and a deployed position and is opaque such that when in the deployed position, the flexible shade obstructs the field of view through the window. The flexible shade is rolled up into the retracted position and is held in place by a shade retaining assembly, such that the flexible shade may readily be deployed as needed. An at least one weight is connected to a distal end of the flexible shade, being positioned opposite the proximal end, in order to assist in deploying the flexible shade. Additionally, a security key is coupled to the distal end for locking the door.

16 Claims, 10 Drawing Sheets

DEPLOYABLE VISION OBSTRUCTER

The current application claims a priority to the U.S. Provisional Patent application Ser. No. 61/773,456 filed on Mar. 6, 2013.

FIELD OF THE INVENTION

The present invention relates generally to an apparatus for obstructing the view of an individual. More specifically, the present invention is a deployable vision obstructer that is attached to a door above a door window, to be used specifically during a lockdown drill or procedure.

BACKGROUND OF THE INVENTION

Public acts of violence unfortunately occur with some frequency, especially in educational environments where academic or peer stress can play a role in an individual's mental state. Measures can be taken in an attempt to reduce or discourage violent acts, such as using metal detectors or personal searches, however, many of the measures taken are not always applicable to other situations or are not infallible. While much effort is put into the prevention of such violent incidences, the reality is that such events still occur. As a result, many institutions practice lockdown drills in an attempt to be prepared for potential life threatening situations. During these drills, individuals are told to remain in the room they are currently in and lock the door. Many of the doors in schools and other institutions have windows that allow the perpetrator to peer inside, allowing them to locate individuals on which they can inflict harm. One of the best ways to prevent a perpetrator from attacking is to block his or her view from the person or object to which the perpetrator intends to inflict harm. If the perpetrator is unaware of the presence of an individual, then the chances of the perpetrator inflicting harm on the given individual are greatly lowered. Additionally, the doors for certain rooms are not always easily locked, especially if the door requires a key and in an emergency situation time is undoubtedly important.

Therefore it is the object of the present invention to provide an apparatus for obstructing an individual's view during lockdown drills and procedures. The present invention is a deployable vision obstructer that is attached to a door surface above a door window. The deployable vision obstructer includes a flexible shade that is opaque and is configurable between a retracted position and a deployed position. The flexible shade is attached to the door surface by means of a mounting assembly being a pair of opposing hook and loop fasteners. When in the retracted position, the flexible shade is rolled above the door window, such that the door window is unobstructed, and is held in place by a shade retaining assembly. When in the deployed position, the flexible shade extends down below the door window, such that the door window is obstructed. A security key for locking the door is also coupled to the flexible shade and is accessible when the flexible shade is in the deployed position.

DETAIL DESCRIPTIONS OF THE INVENTION

All illustrations of the drawings are for the purpose of describing selected versions of the present invention and are not intended to limit the scope of the present invention.

Figure 5:
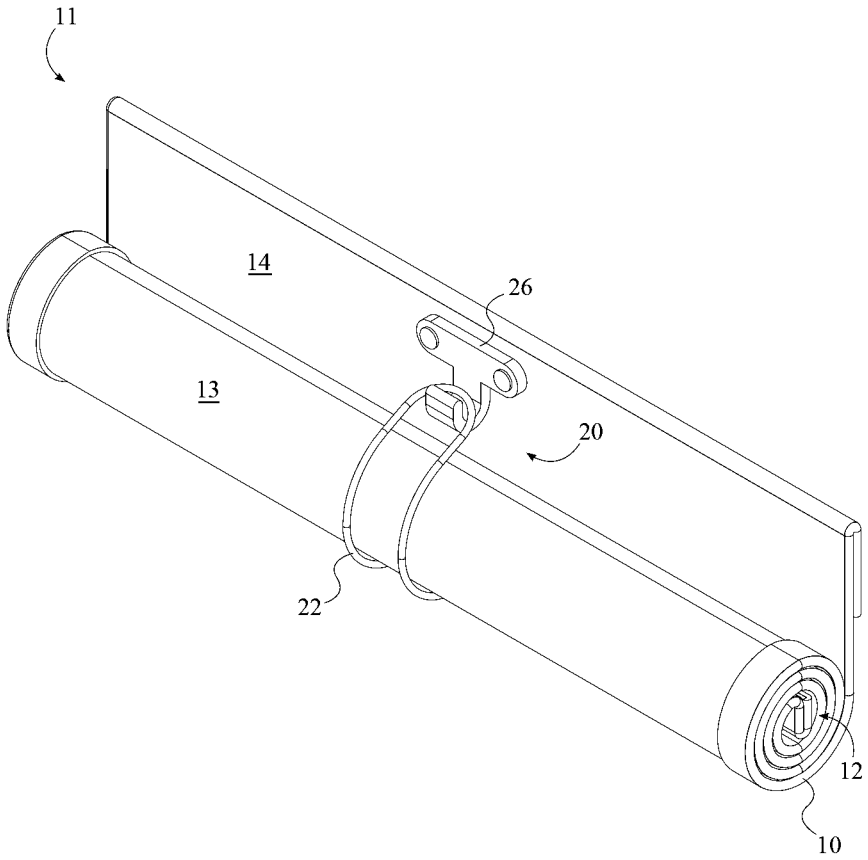
FIG. 5 is a perspective view of the present invention with the flexible shade in a retracted position and being retained by a lashing hook and cord.

The present invention is a deployable vision obstructer specifically for use during lockdown drills and procedures. The deployable vision obstructer comprises a flexible shade 10, a shade retaining assembly 20, a mounting assembly 30, and a security key 40. The flexible shade 10 is an opaque piece of material that is used to obstruct the view of an individual. The flexible shade 10 is designed to be used on an as needed basis and thus is configurable between a retracted position, shown in FIG. 5, and a deployed position, shown in FIG. 1. The shade retaining assembly 20 retains the flexible shade 10 in the retracted position, while the mounting assembly 30 secures the flexible shade 10 to the desired door.

Figure 1:
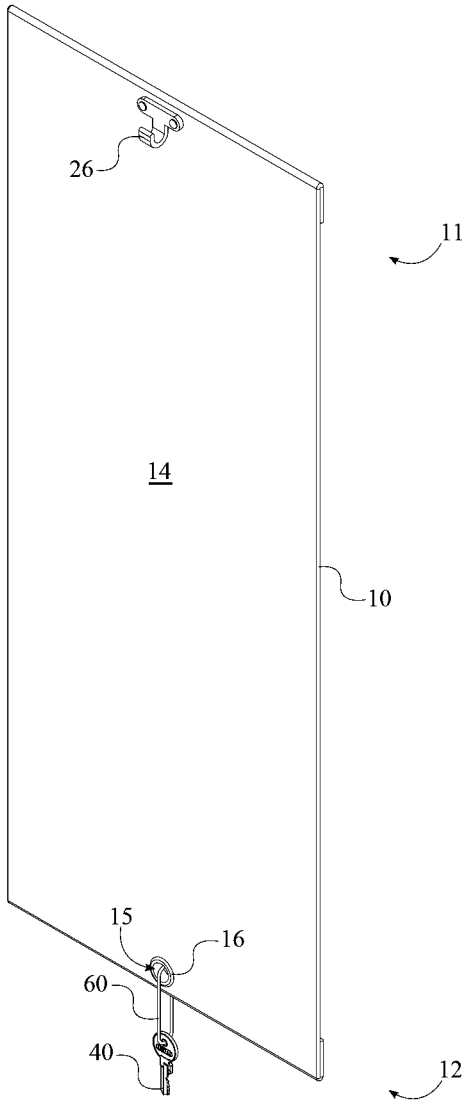
FIG. 1 is a perspective view of the present invention with the flexible shade in a deployed position.
Figure 8:
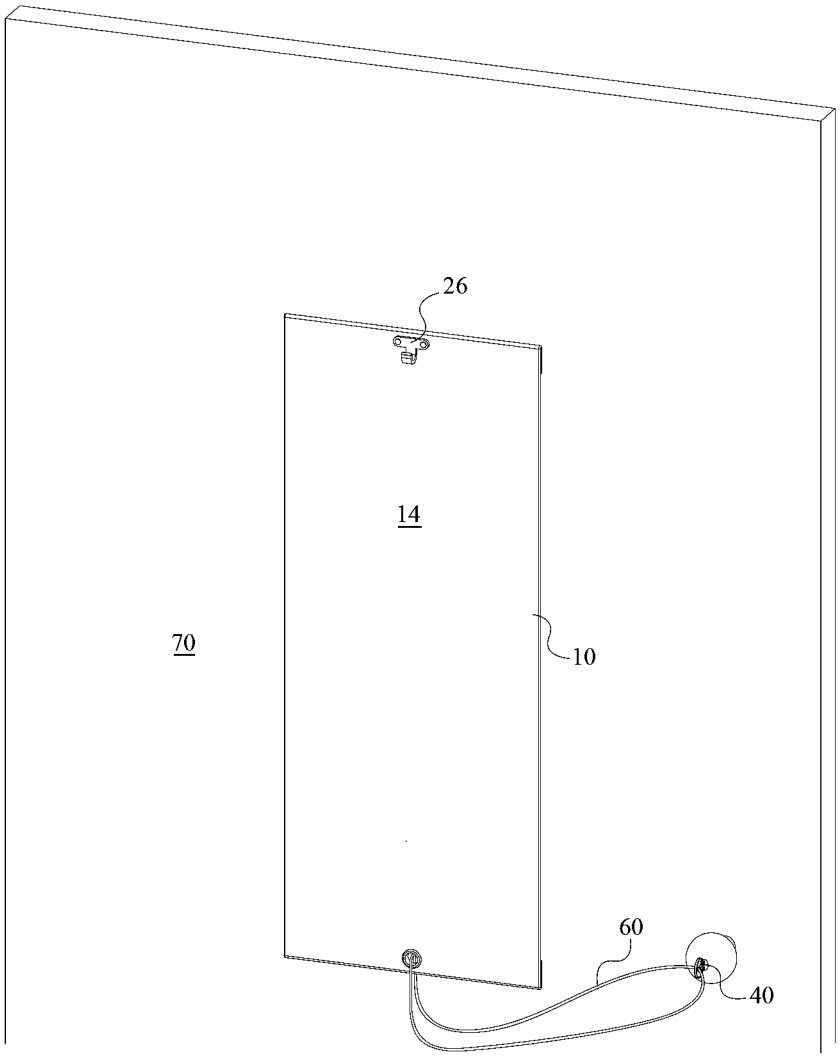
FIG. 8 is a perspective view of the present invention attached to the door surface in the deployed position.

In reference to FIG. 1, the flexible shade 10 comprises a proximal end 11, a distal end 12, a proximal surface 13, a distal surface 14, and an aperture 15. The proximal end 11 and the distal end 12 are positioned opposite each other along the flexible shade 10. Similarly, the proximal surface 13 and the distal surface 14 are positioned opposite each other about the flexible shade 10. When in use, the proximal surface 13 is positioned against a door surface 70 to which the flexible sheet is secured, such that the distal surface 14 faces away from the door surface 70. The proximal end 11 is secured to the door surface 70 above a window, such that the distal end 12 is positioned at the bottom of the window or below the window when the flexible shade 10 is in the deployed position, as shown in FIG. 8. The aperture 15 is positioned through the distal end 12 of the flexible shade 10.

Figure 2:
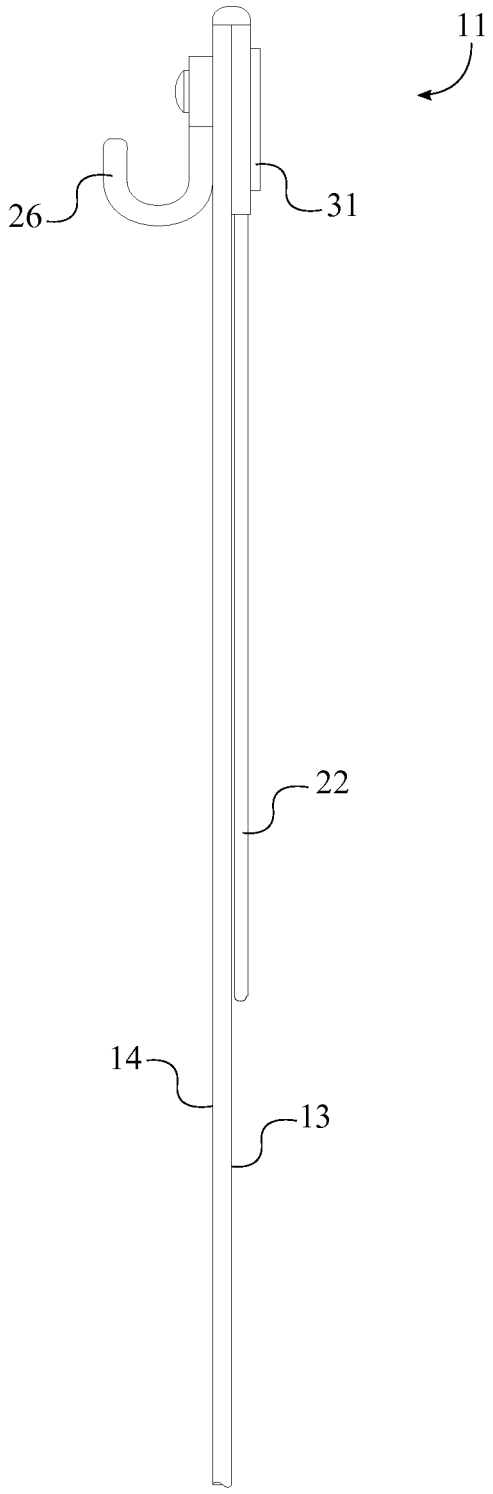
FIG. 2 is a right side elevational view of the top portion of the present invention.
Figure 7:
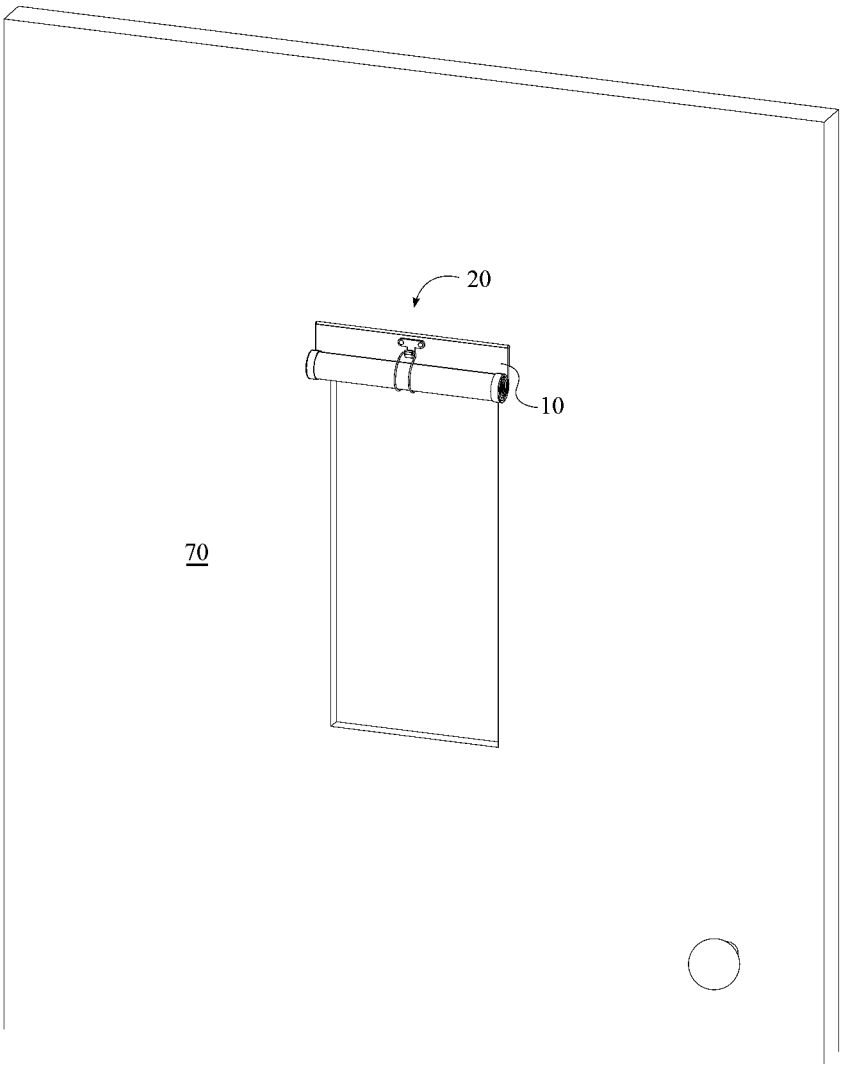
FIG. 7 is a perspective view of the present invention attached to the door surface in the retracted position.

In reference to FIG. 2, the shade retaining assembly 20 is adjacently connected to the proximal end 11 of the flexible shade 10 and is used to secure the flexible shade 10 in the retracted position, such that an individual can view through the window above which the flexible shade 10 is mounted, as shown in FIG. 7. The shade retaining assembly 20 comprises a first fastener 21 and a second fastener 25. The first fastener 21 is adjacently connected to the proximal surface 13, while the second fastener 25 is adjacently connected to the distal surface 14. When the flexible shade 10 is rolled upwards into the retracted position, the first fastener 21 is positioned around the flexible shade 10 and made to engage the second fastener 25, wherein the flexible shade 10 is retained in the retracted position.

In the preferred embodiment of the present invention, the first fastener 21 is a lashing hook 26 and the second fastener 25 is a cord 22. The cord 22 comprises a first end 23 and a second end 24, wherein the first end 23 and the second end 24 are positioned opposite each other along the cord 22. The first end 23 and the second are sewn to the proximal surface 13, such that the cord 22 is positioned in between the flexible shade 10 and the door surface 70, when the flexible shade 10 is attached to the door surface 70. The lashing hook 26 is riveted to the distal surface 14, such that the lashing hook 26 protrudes away from the door. When the flexible shade 10 is rolled upwards into the retracted position, the cord 22 is traversed around the flexible shade 10 and coupled to the lashing hook 26, wherein the flexible shade 10 is retained in the retracted position.

Figure 6:
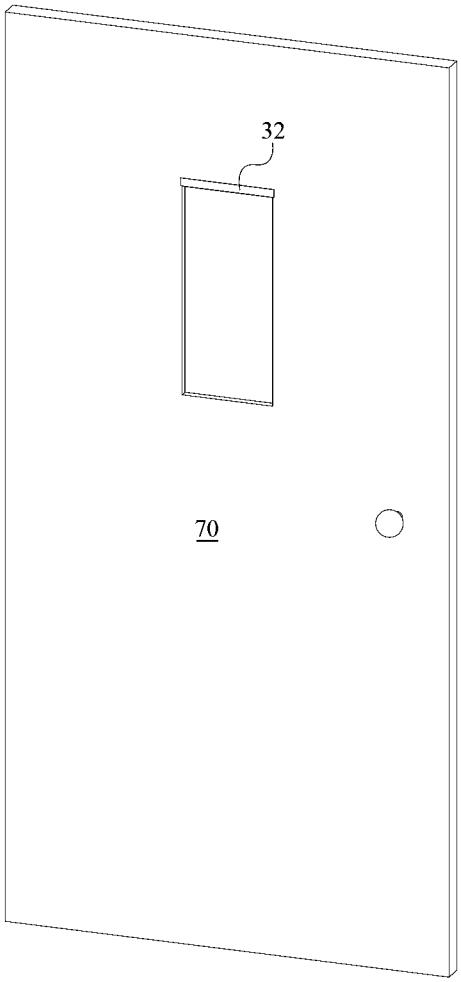
FIG. 6 is a perspective view of a second fastening strip connected to a door surface.
Figure 9:
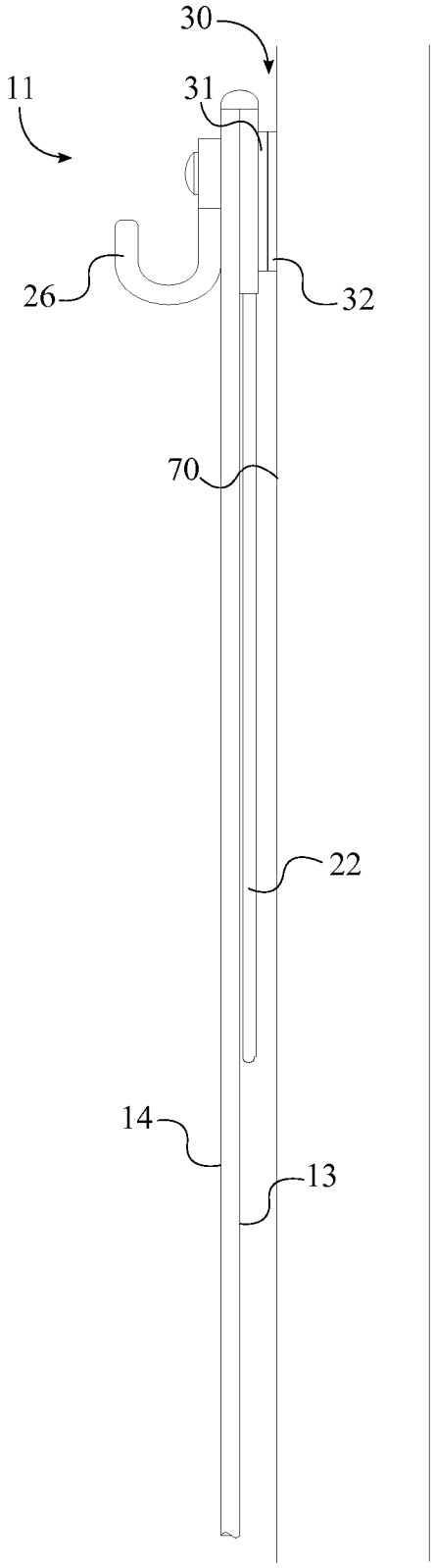
FIG. 9 is a right side elevational view of the flexible shade attached to the door surface via the mounting assembly.
Figure 10:
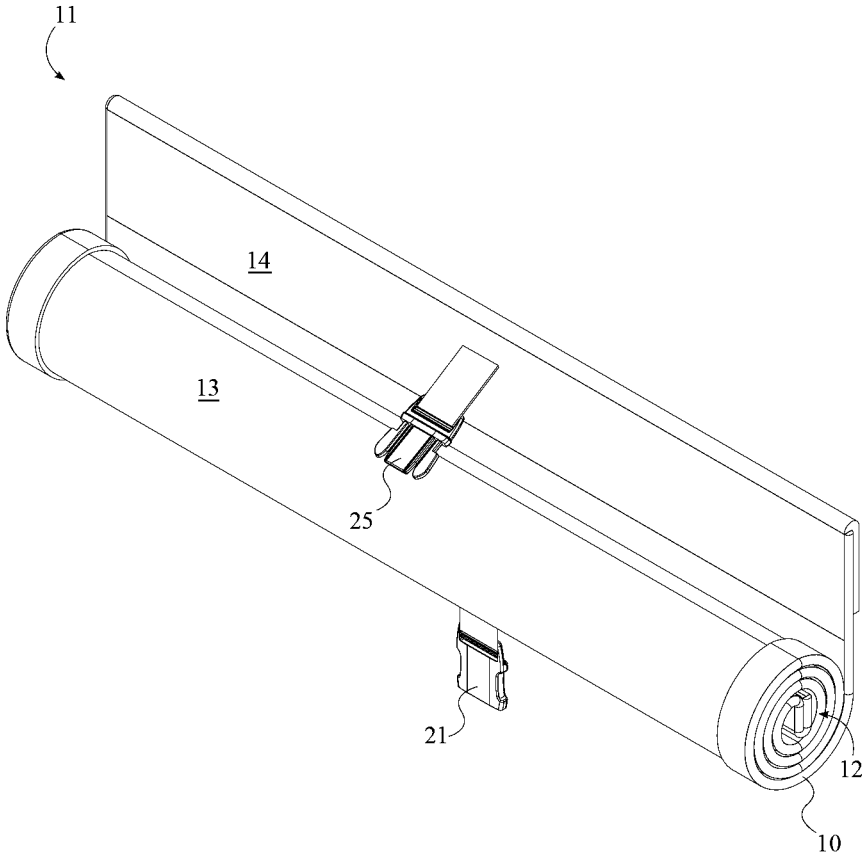
FIG. 10 is a perspective view of the present invention with the flexible shade in the retracted position and the first fastener and the second fastener being a male and female buckle.

In reference to FIG. 9, the mounting assembly 30 is positioned along the proximal end 11 of the flexible shade 10 and is used to secure the flexible sheet to the door surface 70. As such, the mounting assembly 30 is positioned adjacent to the proximal surface 13, such that the mounting assembly 30 is positioned in between the flexible shade 10 and the door. The mounting assembly 30 comprises a first fastening strip 31 and a second fastening strip 32, wherein the first fastening strip 31 and the second fastening strip 32 are opposing hook and loop fasteners. The first fastening strip 31 is adjacently connected to the proximal surface 13 as shown in FIG. 2, while the second fastening strip 32 is adjacently connected to the door surface 70 as shown in FIG. 6, wherein the first fastening strip 31 engages the second fastening strip 32 in order to secure the flexible shade 10 to the door surface 70.

Figure 3:
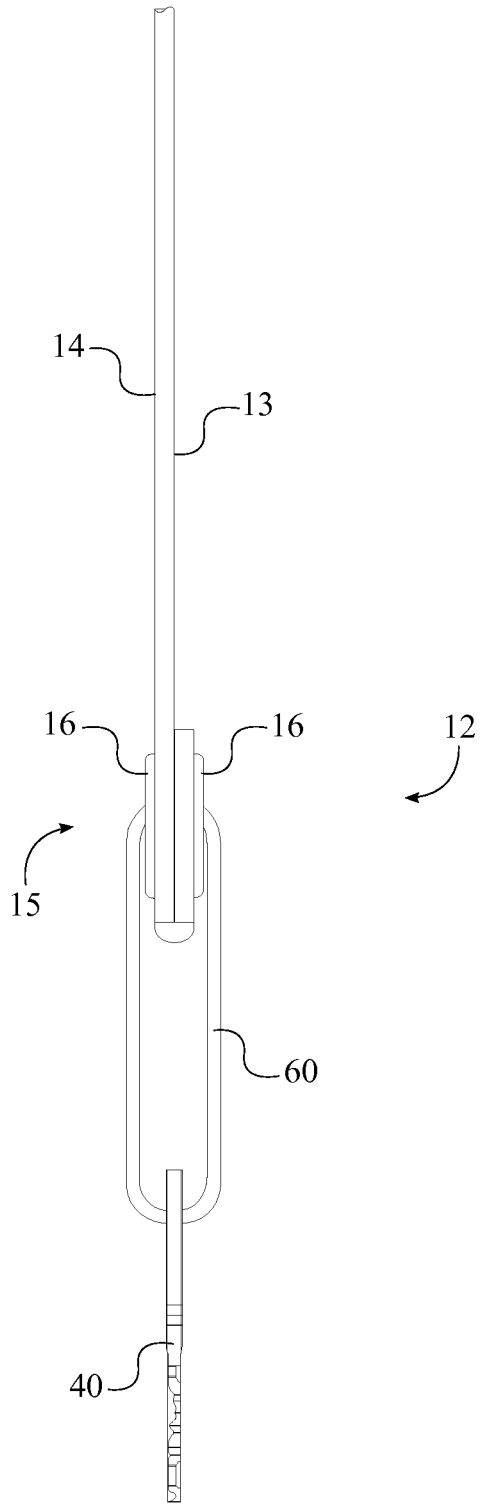
FIG. 3 is a right side elevational view of the bottom portion of the present invention.

In reference to FIG. 3, the security key 40 is coupled to the distal end 12 of the flexible shade 10 and is used to lock the door to which the flexible shade 10 is attached, as shown in FIG. 8. More specifically, the security key 40 is coupled to the aperture 15 through the combination of a grommet 16 and a lanyard 60. The grommet 16 is positioned through the aperture 15 and is positioned on both the proximal surface 13 and the distal surface 14 around the aperture 15, in order to reinforce flexible shade 10 around the aperture 15. The lanyard 60 is positioned through the aperture 15, such that the lanyard 60 is coupled to the grommet 16. The security key 40 is coupled to the lanyard 60 opposite the grommet 16, such that the security key 40 hangs below the distal end 12 of the flexible shade 10 when the flexible shade 10 is in the deployed position. In this way, the security key 40 is readily accessible to lock the door in the event of an emergency.

Figure 4:
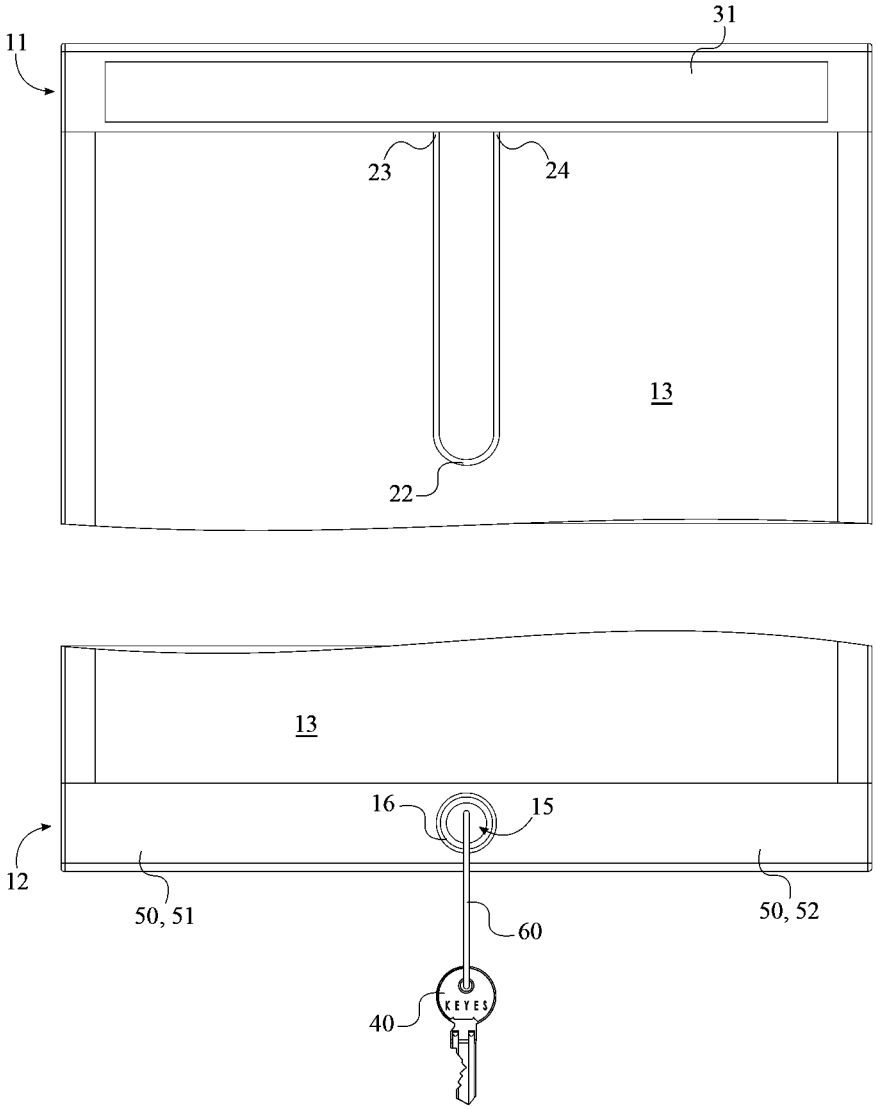
FIG. 4 is a rear elevational view of the top and bottom portion of the present invention.

In reference to FIG. 4, the deployable vision obstructer further comprises an at least one weight 50 to assist in deploying the flexible shade 10. The at least one weight 50 is connected to the distal end 12 of the flexible shade 10, such that when the first fastener 21 of the shade retaining assembly 20 is disengaged from the second fastener 25 the distal end 12 quickly falls downwards due to gravity, configuring the flexible shade 10 into the deployed position. In the preferred embodiment of the present invention, the at least one weight 50 comprises a first weight 51 and a second weight 52. The aperture 15 is centrally positioned along the distal end 12 and the first weight 51 and the second weight 52 are positioned opposite each other along the distal end 12, such that they are evenly spaced from the aperture 15.

In the preferred embodiment of the present invention, the deployable vision obstructer is constructed in the following manner. The flexible shade 10 is cut from a piece of fabric according to the dimensions of the window for which the flexible shade 10 is intended to cover. Each edge of the flexible shade 10 is then stitched using a four-thread overlock stitch, or similar stitch, in order to reinforce the edges of the flexible shade 10 while allowing the flexible shade 10 to maintain flexibility. A portion of the two sides perpendicular to the proximal end 11 and the distal end 12 are then folded over and are straight stitched from the proximal end 11 to the distal end 12 forming a first folded edge and second folded edge. The first weight 51 and the second weight 52 are then stitched to opposing corners on the proximal surface 13, such that a bottom section of material remains below the first weight 51 and the second weight 52 along the distal end 12. The bottom section of material is then folded over the first weight 51 and the second weight 52 and stitched to the proximal surface 13 along the distal end 12. The aperture 15 is then cut through the distal end 12 and the grommet 16 is positioned through the aperture 15 and connected to the flexible shade 10. A top section of material along the proximal end 11 is then folded over towards the proximal surface 13 and stitched to the proximal surface 13 along the proximal end 11. The lashing hook 26 is then riveted to the distal surface 14 along the proximal end 11, while the first end 23 and the second end 24 of the cord 22 are sewn to the proximal surface 13 along the proximal end 11. The first fastening strip 31 is then stitched to the top section of material, along the proximal edge. Finally, the lanyard 60 is looped through the grommet 16 and the security key 40 is attached to the lanyard 60. While the above describes the preferred method of constructing the present invention, it is possible for the deployable vision obstructer to be constructed in any number of similar ways.

Although the invention has been explained in relation to its preferred embodiment, it is to be understood that many other possible modifications and variations can be made without departing from the spirit and scope of the invention as hereinafter claimed.

What is claimed is:

1. A deployable vision obstructer comprises:
- a flexible shade;
- a shade retaining assembly;
- a mounting assembly;
- the flexible shade comprises a proximal end, a distal end, a proximal surface, a distal surface, and an aperture;
- the proximal end and the distal end being positioned opposite each other along the flexible shade;
- the proximal surface and the distal surface being positioned opposite each other about the flexible shade;
- the shade retaining assembly being adjacently connected to the proximal end;
- the mounting assembly being positioned along the proximal end;
- the mounting assembly being positioned adjacent to the proximal surface;
- the aperture being positioned through the distal end;
- the flexible shade being opaque;
- a lanyard;
- the flexible shade further comprises a grommet;
- the grommet being positioned through the aperture;
- the lanyard cord being coupled to the grommet;
- a security key; and
- the security key being coupled to the lanyard opposite the grommet.

2. The deployable vision obstructer as claimed in claim 1 comprises:
- the shade retaining assembly comprises a first fastener and a second fastener;
- the first fastener being adjacently connected to the proximal surface; and
- the second fastener being adjacently connected to the distal surface.

3. The deployable vision obstructer as claimed in claim 2 comprises:
- the flexible shade being rolled into a retracted position;
- the first fastener being positioned around the flexible shade; and the first fastener engaging the second fastener, wherein the flexible shade is retained in the retracted position.

4. The deployable vision obstructer as claimed in claim 2 comprises:

the first fastener being a lashing hook;

the second fastener being a cord;

the cord comprises a first end and a second end;

the first end and the second end being positioned opposite each other along the cord;

the first end and the second end being sewn to the proximal surface; and the lashing hook being riveted to the distal surface.

5. The deployable vision obstructer as claimed in claim 4 comprises:

the flexible shade being rolled into a retracted position;

the cord traversing around the flexible shade; and the cord being coupled to the lashing hook.

6. The deployable vision obstructer as claimed in claim 1 comprises:

the mounting assembly comprises a first fastening strip and a second fastening strip;

the first fastening strip being adjacently connected to the proximal end;

the second fastening strip being adjacently connected to a door surface; and the first fastening strip engaging the second fastening strip.

7. The deployable vision obstructer as claimed in claim 1 comprises:

an at least one drapery weight; and the at least one drapery weight being connected to the distal end.

8. The deployable vision obstructer as claimed in claim 7 comprises:

the at least one drapery weight comprises a first weight and a second weight; and the first weight and the second weight being positioned opposite each other along the distal end.

9. A deployable vision obstructer comprises:

a flexible shade;

a shade retaining assembly;

a mounting assembly;

a lanyard;

an at least one drapery weight;

the flexible shade comprises a proximal end, a distal end, a proximal surface, a distal surface, and an aperture;

the shade retaining assembly comprises a first fastener and a second fastener;

the mounting assembly comprises a first fastening strip and a second fastening strip;

the proximal end and the distal end being positioned opposite each other along the flexible shade;

the proximal surface and the distal surface being positioned opposite each other about the flexible shade;

the shade retaining assembly being adjacently connected to the proximal end;

the mounting assembly being positioned along the proximal end;

the mounting assembly being positioned adjacent to the proximal surface;

the first fastener being adjacently connected to the proximal surface;

the second fastener being adjacently connected to the distal surface;

the first fastening strip being adjacently connected to the proximal end;

the second fastening strip being adjacently connected to a door surface;

the first fastening strip engaging the second fastening strip;

the aperture being positioned through the distal end;

the grommet being positioned through the aperture;

the lanyard cord being coupled to the grommet;

the at least one drapery weight being connected to the distal end;

the flexible shade being opaque;

a security key; and the security key being coupled to the lanyard opposite the grommet.

10. The deployable vision obstructer as claimed in claim 9 comprises:

the flexible shade being rolled into a retracted position;

the first fastener being positioned around the flexible shade; and the first fastener engaging the second fastener, wherein the flexible shade is retained in the retracted position.

11. The deployable vision obstructer as claimed in claim 9 comprises:

the first fastener being a lashing hook;

the second fastener being a cord;

the cord comprises a first end and a second end;

the first end and the second end being positioned opposite each other along the cord;

the first end and the second end being sewn to the proximal surface; and the lashing hook being riveted to the distal surface.

12. The deployable vision obstructer as claimed in claim 11 comprises:

the flexible shade being rolled into a retracted position;

the cord traversing around the flexible shade; and the cord being coupled to the lashing hook.

13. The deployable vision obstructer as claimed in claim 9 comprises:

the at least one drapery weight comprises a first weight and a second weight; and the first weight and the second weight being positioned opposite each other along the distal end.

14. A deployable vision obstructer comprises:

a flexible shade;

a shade retaining assembly;

a mounting assembly;

a lanyard;

an at least one drapery weight;

the flexible shade comprises a proximal end, a distal end, a proximal surface, a distal surface, and an aperture;

the shade retaining assembly comprises a lashing hook and a cord;

the mounting assembly comprises a first fastening strip and a second fastening strip;

the cord comprises a first end and a second end;

the proximal end and the distal end being positioned opposite each other along the flexible shade;

the proximal surface and the distal surface being positioned opposite each other about the flexible shade;

the shade retaining assembly being adjacently connected to the proximal end;

the mounting assembly being positioned along the proximal end;

the mounting assembly being positioned adjacent to the proximal surface;

the first end and the second end being positioned opposite each other along the cord;

the first end and the second end being sewn to the proximal surface;

the lashing hook being riveted to the distal surface;

the first fastening strip being adjacently connected to the proximal end;

the second fastening strip being adjacently connected to a door surface;

the first fastening strip engaging the second fastening strip;

the aperture being positioned through the distal end;

the grommet being positioned through the aperture;

the lanyard cord being coupled to the grommet;

the at least one drapery weight being connected to the distal end;

the flexible shade being opaque;

a security key; and the security key being coupled to the lanyard opposite the grommet.

15. The deployable vision obstructer as claimed in claim 14 comprises:

the flexible shade being rolled into a retracted position;

the cord traversing around the flexible shade; and the cord being coupled to the lashing hook.

16. The deployable vision obstructer as claimed in claim 14 comprises:

the at least one drapery weight comprises a first weight and a second weight; and the first weight and the second weight being positioned opposite each other along the distal end.

* * * * *